US010342279B2

(12) United States Patent
Knight

(10) Patent No.: US 10,342,279 B2
(45) Date of Patent: Jul. 9, 2019

(54) CONCERTINAED STRUCTURES IN PROTECTIVE GEAR

(71) Applicant: Brainguard Technologies, Inc., El Cerrito, CA (US)

(72) Inventor: Robert T. Knight, El Cerrito, CA (US)

(73) Assignee: Brainguard Technologies, Inc., El Cerrito, CA (US)

( * ) Notice: Subject to any disclaimer, the term of this patent is extended or adjusted under 35 U.S.C. 154(b) by 434 days.

(21) Appl. No.: 14/570,883

(22) Filed: Dec. 15, 2014

(65) Prior Publication Data

US 2016/0165993 A1 Jun. 16, 2016

(51) Int. Cl.
*A42B 3/06* (2006.01)
*A42B 3/12* (2006.01)
*A41D 13/05* (2006.01)

(52) U.S. Cl.
CPC ..... *A42B 3/064* (2013.01); *A41D 13/05* (2013.01); *A42B 3/065* (2013.01); *A42B 3/124* (2013.01)

(58) Field of Classification Search
CPC ..... A42B 3/064; A42B 3/124; A42B 3/065; A42B 3/00; A42B 3/063; F41H 5/007; F41H 5/04; F41H 5/08; F41H 5/0492; F41H 1/02; A63B 71/10; A63B 71/08; A41D 13/05; A41D 13/0518; A41D 13/065; A41D 13/06
USPC ..... 2/411, 455, 413, 425, 6.8, 2.5, 459, 463, 2/464, 465, 466, 467; 89/36.05
See application file for complete search history.

(56) References Cited

U.S. PATENT DOCUMENTS

| | | | | |
|---|---|---|---|---|
| 3,087,165 | A | 4/1963 | Cairns | |
| 3,497,873 | A | 3/1970 | Benner | |
| 5,204,998 | A * | 4/1993 | Liu | A42B 3/121 2/411 |
| 2004/0168246 | A1* | 9/2004 | Phillips | A42B 3/064 2/411 |
| 2007/0226881 | A1 | 10/2007 | Reinhard et al. | |
| 2012/0198604 | A1* | 8/2012 | Weber | A42B 3/125 2/414 |
| 2014/0173810 | A1* | 6/2014 | Suddaby | A42B 3/124 2/413 |
| 2015/0264991 | A1* | 9/2015 | Frey | A42B 3/064 2/411 |

FOREIGN PATENT DOCUMENTS

WO 2016100194 A1 6/2016

OTHER PUBLICATIONS

"Int'l Application Serial No. PCT/US15/65523 Preliminary Report on Patentability dated Jun. 29, 2017", 7 pages.
"Int'l Application Serial No. PCT/US2015/065523, Search Report and Written Opinion dated Feb. 12, 2016", 8 pgs.

* cited by examiner

*Primary Examiner* — Nathan E Durham
*Assistant Examiner* — Abby M Spatz
(74) *Attorney, Agent, or Firm* — Kwan & Olynick LLP

(57) ABSTRACT

Protective gear such as a helmet includes multiple shell layers connected using one or more concertinaed structures. The concertinaed structures allow the shell layers greater flexibility to move relative to each other when mechanical forces are imparted onto the outer shell layer. When energy and impact transformer layers are disposed between the shell layers, the concertinaed structures may also allow improvement function of the energy and impact transformer layers.

8 Claims, 8 Drawing Sheets

CONCERTINAED STRUCTURES IN PROTECTIVE GEAR

TECHNICAL FIELD

The present disclosure relates to concertinaed structures in protective gear.

DESCRIPTION OF RELATED ART

Protective gear such as sports and safety helmets are designed to reduce direct impact forces that can mechanically damage an area of contact. Protective gear will typically include padding and a protective shell to reduce the risk of physical head injury. Liners are provided beneath a hardened exterior shell to reduce violent deceleration of the head in a smooth uniform manner and in an extremely short distance, as liner thickness is typically limited based on helmet size considerations.

Protective gear is reasonably effective in preventing injury. Nonetheless, the effectiveness of protective gear remains limited. Consequently, various mechanisms are provided to improve movement of shell layers in helmets and other protective gear during the application of impact forces.

BRIEF DESCRIPTION OF THE DRAWINGS

The disclosure may best be understood by reference to the following description taken in conjunction with the accompanying drawings, which illustrate particular embodiments.

DESCRIPTION OF EXAMPLE EMBODIMENTS

Figure 1:
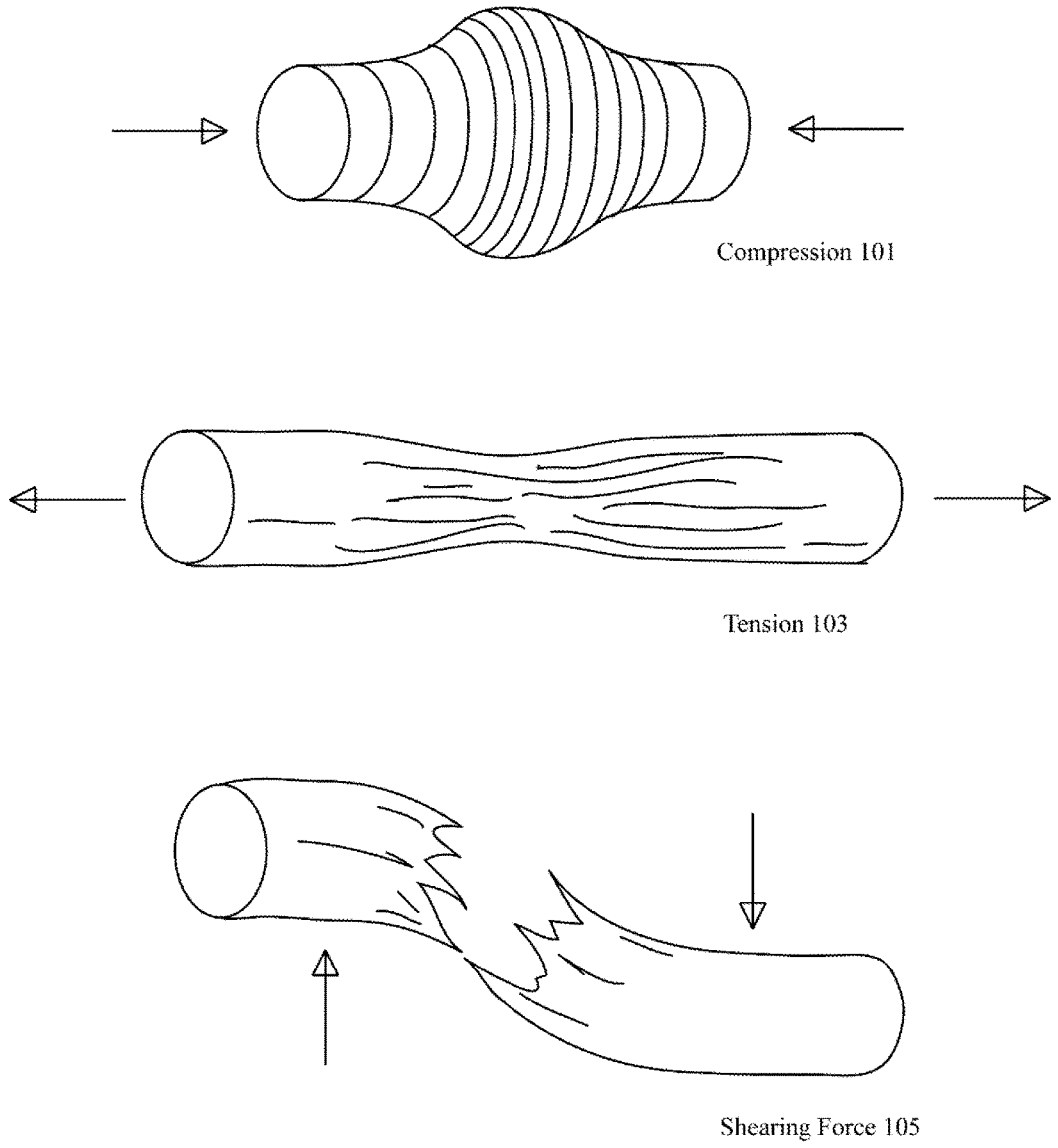
FIG. 1 illustrates types of forces on axonal fibers.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

For example, the techniques of the present invention will be described in the context of helmets. However, it should be noted that the techniques of the present invention apply to a wide variety of different pieces of protective gear. In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise. For example, a protective device may use a single strap in a variety of contexts. However, it will be appreciated that a system can use multiple straps while remaining within the scope of the present invention unless otherwise noted. Furthermore, the techniques and mechanisms of the present invention will sometimes describe a connection between two entities. It should be noted that a connection between two entities does not necessarily mean a direct, unimpeded connection, as a variety of other entities may reside between the two entities. For example, different layers may be connected using a variety of materials. Consequently, a connection does not necessarily mean a direct, unimpeded connection unless otherwise noted.

Overview

Protective gear such as a helmet includes multiple shell layers connected using one or more concertinaed structures. The concertinaed structures allow the shell layers greater flexibility to move relative to each other when mechanical forces are imparted onto the outer shell layer. When energy and impact transformer layers are disposed between the shell layers, the concertinaed structures may also allow improvement function of the energy and impact transformer layers.

Example Embodiments

Protective gear such as knee pads, shoulder pads, and helmets are typically designed to prevent direct impact injuries or trauma. For example, many pieces of protective gear reduce full impact forces that can structurally damage an area of contact such as the skull or knee. Major emphasis is placed on reducing the likelihood of cracking or breaking of bone. However, the larger issue is preventing the tissue and neurological damage caused by rotational forces, shear forces, oscillations, and tension/compression forces.

For head injuries, the major issue is neurological damage caused by oscillations of the brain in the cranial vault resulting in coup-contracoup injuries manifested as direct contusions to the central nervous system (CNS), shear injuries exacerbated by rotational, tension, compression, and/or shear forces resulting in demyelination and tearing of axonal fibers; and subdural or epidural hematomas. Because of the emphasis in reducing the likelihood of cracking or breaking bone, many pieces of protective gear do not sufficiently dampen, transform, dissipate, and/or distribute the rotational, tension, compression, and/or shear forces, but rather focus on absorbing the direct impact forces over a small area, potentially exacerbating the secondary forces on the CNS. Initial mechanical damage results in a secondary cascade of tissue and cellular damage due to increased glutamate release or other trauma induced molecular cascades.

Traumatic brain injury (TBI) has immense personal, societal and economic impact. The Center for Disease Control and Prevention documented 1.4 million cases of TBI in the USA in 2007. This number was based on patients with a loss of consciousness from a TBI resulting in an Emergency Room visit. With increasing public awareness of TBI this number increased to 1.7 million cases in 2010. Of these cases there were 52,000 deaths and 275,000 hospitalizations, with the remaining 1.35 million cases released from the ER.

Of these 1.35 million discharged cases at least 150,000 people will have significant residual cognitive and behavioral problems at 1-year post discharge from the ER. Notably, the CDC believes these numbers under represent the problem since many patients do not seek medical evaluation for brief loss of consciousness due to a TBI. These USA numbers are similar to those observed in other developed countries and are likely higher in third-world countries with poorer vehicle and head impact protection. To put the problem in a clearer perspective, the World Health Organization (WHO) anticipates that TBI will become a leading cause of death and disability in the world by the year 2020.

The CDC numbers do not include head injuries from military actions. Traumatic brain injury is widely cited as the "signature injury" of Operation Enduring Freedom and Operation Iraqi Freedom. The nature of warfare conducted in Iraq and Afghanistan is different from that of previous wars and advances in protective gear including helmets as well as improved medical response times allow soldiers to survive events such as head wounds and blast exposures that previously would have proven fatal. The introduction of the Kevlar helmet has drastically reduced field deaths from bullet and shrapnel wounds to the head. However, this increase in survival is paralleled by a dramatic increase in residual brain injury from compression and rotational forces to the brain in TBI survivors. Similar to that observed in the civilian population the residual effects of military deployment related TBI are neurobehavioral symptoms such as cognitive deficits and emotional and somatic complaints. The statistics provided by the military cite an incidence of 6.2% of head injuries in combat zone veterans. One might expect these numbers to hold in other countries.

In addition to the incidence of TBI in civilians from falls and vehicular accidents or military personnel in combat there is increasing awareness that sports-related repetitive forces applied to the head with or without true loss of consciousness can have dire long-term consequences. It has been known since the 1920's that boxing is associated with devastating long-term issues including "dementia pugilistica" and Parkinson-like symptoms (i.e. Mohammed Ali). We now know that this repetitive force on the brain dysfunction extends to many other sports. Football leads the way in concussions with loss of consciousness and post-traumatic memory loss (63% of all concussions in all sports), wrestling comes in second at 10% and soccer has risen to 6% of all sports related TBIs. In the USA 63,000 high school students suffer a TBI per year and many of these students have persistent long-term cognitive and behavioral issues. This disturbing pattern extends to professional sports where impact forces to the body and head are even higher due to the progressive increase in weight and speed of professional athletes. Football has dominated the national discourse in the area but serious and progressive long-term neurological issues are also seen in hockey and soccer players and in any sport with the likelihood of a TBI. Repetitive head injuries result in progressive neurological deterioration with neuropathological findings mimicking Alzheimer's disease. This syndrome with characteristic post-mortem neuropathological findings on increases in Tau proteins and amyloid plaques is referred to as Chronic Traumatic Encephalopathy (CTE).

The human brain is a relatively delicate organ weighing about 3 pounds and having a consistency a little denser than gelatin and close to that of the liver. From an evolutionary perspective, the brain and the protective skull were not designed to withstand significant external forces. Because of this poor impact resistance design, external forces transmitted through the skull to the brain that is composed of over 100 billion cells and up to a trillion connecting fibers results in major neurological problems. These injuries include contusions that directly destroy brain cells and tear the critical connecting fibers necessary to transmit information between brain cells.

Contusion injuries are simply bleeding into the substance of the brain due to direct contact between the brain and the bony ridges of the inside of the skull. Unfortunately, the brain cannot tolerate blood products and the presence of blood kicks off a biological cascade that further damages the brain. Contusions are due to the brain oscillating inside the skull when an external force is applied. These oscillations can include up to three cycles back and forth in the cranial vault and are referred to as coup-contra coup injuries. The coup part of the process is the point of contact of the brain with the skull and the contra-coup is the next point of contact when the brain oscillates and strikes the opposite part of the inside of the skull.

The inside of the skull has a series of sharp bony ridges in the front of the skull and when the brain is banged against these ridges it is mechanically torn resulting in a contusion. These contusion injuries are typically in the front of the brain damaging key regions involved in cognitive and emotional control.

Shear injuries involve tearing of axonal fibers. The brain and its axonal fibers are extremely sensitive to rotational forces. Boxers can withstand hundreds of punches directly in the face but a single round-house punch or upper cut where the force comes in from the side or bottom of the jaw will cause acute rotation of the skull and brain and typically a knock-out. If the rotational forces are severe enough, the result is tearing of axons.

FIG. 1 below shows how different forces affect axons. Compression 101 and tension 103 can remove the protective coating on an axon referred to as a myelin sheath. The myelin can be viewed as the rubber coating on a wire. If the internal wire of the axon is not cut the myelin can re-grow and re-coat the "wire" which can resume axonal function and brain communication. If rotational forces are significant, shear forces 105 tear the axon. This elevates the problem since the ends of cut axons do not re-attach. This results in a permanent neurological deficit and is referred to as diffuse axonal injury (DAI), a major cause of long-term neurological disability after TBI.

Some more modern pieces of protective gear have been introduced with the awareness that significant injuries besides musculoskeletal or flesh injuries in a variety of activities require new protective gear designs.

U.S. Pat. No. 7,076,811 issued to Puchalski describes a helmet with an impact absorbing crumple or shear zone. "The shell consists of three (or more) discrete panels that are physically and firmly coupled together providing rigid protection under most circumstances, but upon impact the panels move relative to one another, but not relative to the user's head, thereby permitting impact forces to be dissipated and/or redirected away from the cranium and brain within. Upon impact to the helmet, there are sequential stages of movement of the panels relative to each other, these movements initially being recoverable, but with sufficient vector forces the helmet undergoes structural changes in a pre-determined fashion, so that the recoverable and permanent movements cumulatively provide a protective 'crumple zone' or 'shear zone'."

U.S. Pat. No. 5,815,846 issued to Calonge describes "An impact resistant helmet assembly having a first material layer coupled to a second material layer so as to define a gas chamber therebetween which contains a quantity that provides impact dampening upon an impact force being applied to the helmet assembly. The helmet assembly further includes a containment layer disposed over the second material layer and structured to define a fluid chamber in which a quantity of fluid is disposed. The fluid includes a generally viscous gel structured to provide some resistance against disbursement from an impacted region of the fluid chamber to non-impacted regions of the fluid chamber, thereby further enhance the impact distribution and dampening of the impact force provided by the helmet assembly."

U.S. Pat. No. 5,956,777 issued to Popovich describes "A helmet for protecting a head by laterally displacing impact forces, said helmet comprising: a rigid inner shell formed as a single unit; a resilient spacing layer disposed outside of and in contact with said inner shell; and an articulated shell having a plurality of discrete rigid segments disposed outside of and in contact with said resilient spacing layer and a plurality of resilient members which couple adjacent ones of said rigid segments to one another."

U.S. Pat. No. 6,434,755 issued to Halstead describes a football helmet with liner sections of different thicknesses and densities. The thicker, softer sections would handle less intense impacts, crushing down until the thinner, harder sections take over to prevent bottoming out.

Still other ideas relate to using springs instead of crushable materials to manage the energy of an impact. Springs are typically associated with rebound, and energy stored by the spring is returned to the head. This may help in some instances, but can still cause significant neurological injury. Avoiding energy return to the head is a reason that non-rebounding materials are typically used.

Some of the protective gear mechanisms are not sufficiently biomechanically aware and are not sufficiently customized for particular areas of protection. These protective gear mechanisms also are not sufficiently active at the right time scales to avoid damage. For example, in many instances, materials like gels may only start to convert significant energy into heat after significant energy has been transferred to the brain. Similarly, structural deformation mechanisms may only break and absorb energy after a significant amount of energy has been transferred to the brain.

Current mechanisms are useful for particular circumstances but are limited in their ability to protect against numerous types of neurological damage. Consequently, an improved smart biomechanics aware and energy conscious protective gear mechanism is provided to protect against mechanical damage as well as neurological damage.

According to various embodiments, protective gear such as a helmet includes a container device to provide a structural mechanism for holding an energy and impact transformer. The design of this element could be a part of the smart energy conscious biomechanics aware design for protection. The energy and impact transformer includes a mechanism for the dissipation, transformation, absorption, redirection or force/energy at the right time scales (in some cases as small as a few milliseconds or hundreds of microseconds).

In particular embodiments, the container mechanism provides structure to allow use of an energy and impact transformer. The container mechanism may be two or three shells holding one or more layers of energy and impact transformer materials. That is, a multiple shell structure may have energy and impact transformer materials between adjacent shell layers. The shells may be designed to prevent direct penetration from any intruding or impeding object. In some examples, the outer shell may be associated with mechanisms for impact distribution, energy transformation, force dampening, and shear deflection and transformation. In some examples, the container mechanism can be constructed of materials such as polycarbonate, fiberglass, Kevlar, metal, alloys, combinations of materials, etc.

According to various embodiments, the energy and impact transformer provides a mechanism for the dissipation, transformation, absorption, and redirection of force and energy at the appropriate time scales. The energy and impact transformer may include a variety of elements. In some examples, a mechanical transformer element connects multiple shells associated with a container mechanism with mechanical structures or fluids that help transform the impact or shear forces on an outer shell into more benign forces or energy instead of transferring the impact or shear forces onto an inner shell.

In some examples, a mechanical transformer layer is provided between each pair of adjacent shells. The mechanical transform may use a shear truss-like structure connecting an outer shell and an inner shell that dampens any force or impact. In some examples, shear truss structure layers connect an outer shell to a middle shell and the middle shell to an inner shell. According to various embodiments, the middle shell or center shell may slide relative to the inner shell and reduce the movement and/or impact imparted on an outer shell. In particular embodiments, the outer shell may slide up to several centimeters relative to the middle shell. In particular embodiments, the material used for connecting the middle shell to the outer shell or the inner shell could be a material that absorbs/dissipates mechanical energy as thermal energy or transformational energy. The space between the outer shell, the middle shell, and the inner shell can be filled with absorptive/dissipative material such as fluids and gels.

According to various embodiments, the energy and impact transformer may also include an electro-rheological element. Different shells may be separated by an electro-rheological element with electric field dependent viscosity. The element may essentially stay solid most of the time. When there is stress/strain on an outer shell, the electric field is activated so that the viscosity changes depending on the level of stress/strain. Shear forces on an inner shell are reduced to minimize impact transmission.

In particular embodiments, the energy and impact transformer also includes a magneto-rheological element. Various shells may be separated by magneto rheological elements with magnetic field dependent viscosity. The element may essentially stay solid most of the time. When there is stress/strain on an outer shell, the magnetic field is activated so that the viscosity changes depending on the level of stress/strain. Shear forces on an inner shell are reduced to minimize impact transmission.

Electro-rheological and magneto-rheological elements may include smart fluids with properties that change in the presence of electric field or a magnetic field. Some smart fluids undergo changes in viscosity when a magnetic field is applied. For example, a smart fluid may change from a liquid to a gel when magnets line up to create a magnetic field. Smart fluids may react within milliseconds to reduce impact and shear forces between shells.

In other examples, foam and memory foam type elements may be included to absorb and distribute forces. In some examples, foam and memory foam type elements may reside beneath the inner shell. A magnetic suspension element may be used to actively or passively reduce external forces. An inner core and an outer core may be separated by magnets that resist each other, e.g. N-poles opposing each other. The inner and outer cores naturally would want to move apart, but are pulled together by elastic materials. When an outer shell is impact and the magnets are pushed closer, forces between the magnets increase through the air gap.

According to various embodiments, a concentric geodesic dome element includes a series of inner shells, each of which is a truss based geodesic dome, but connected to the outer geodesic through structural or fluidic mechanisms. This allows each geodesic structure to fully distribute its own shock load and transmit it in a uniform manner to the dome underneath. The sequence of geodesic structures and the separation by fluid provides uniform force distribution and/or dissipation that protects the inner most shell from these impacts.

In particular embodiments, a fluid/accordion element would separate an inner shell and an outer shell using an accordion with fluid/gel in between. This would allow shock from the outer core to be transmitted and distributed through the enclosed fluid uniformly while the accordion compresses to accommodate strain. A compressed fluid/piston/spring element could include piston/cylinder like elements with a compressed fluid in between that absorbs the impact energy while increasing the resistance to the applied force. The design could include additional mechanical elements like a spring to absorb/dissipate the energy.

In still other examples, a fiber element involves using a rippled outer shell with texture like that of a coconut. The outer shell may contain dense coconut fiber like elements that separate the inner core from the outer core. The shock can be absorbed by the outer core and the fibrous filling. Other elements may also be included in an inner core structure. In some examples, a thick stretchable gel filled bag wrapped around the inner shell could expand and contract in different areas to instantaneously transfer and distribute forces. The combination of the elasticity of a bag and the viscosity of the gel could provide for cushioning to absorb/dissipate external forces.

According to various embodiments, a container device includes multiple shells such as an outer shell, a middle shell, and an inner shell. The shells may be separated by energy and impact transformer mechanisms. In some examples, the shells and the energy and impact transformer mechanisms can be integrated or a shell can also operate as an energy and impact transformer.

Figure 2:
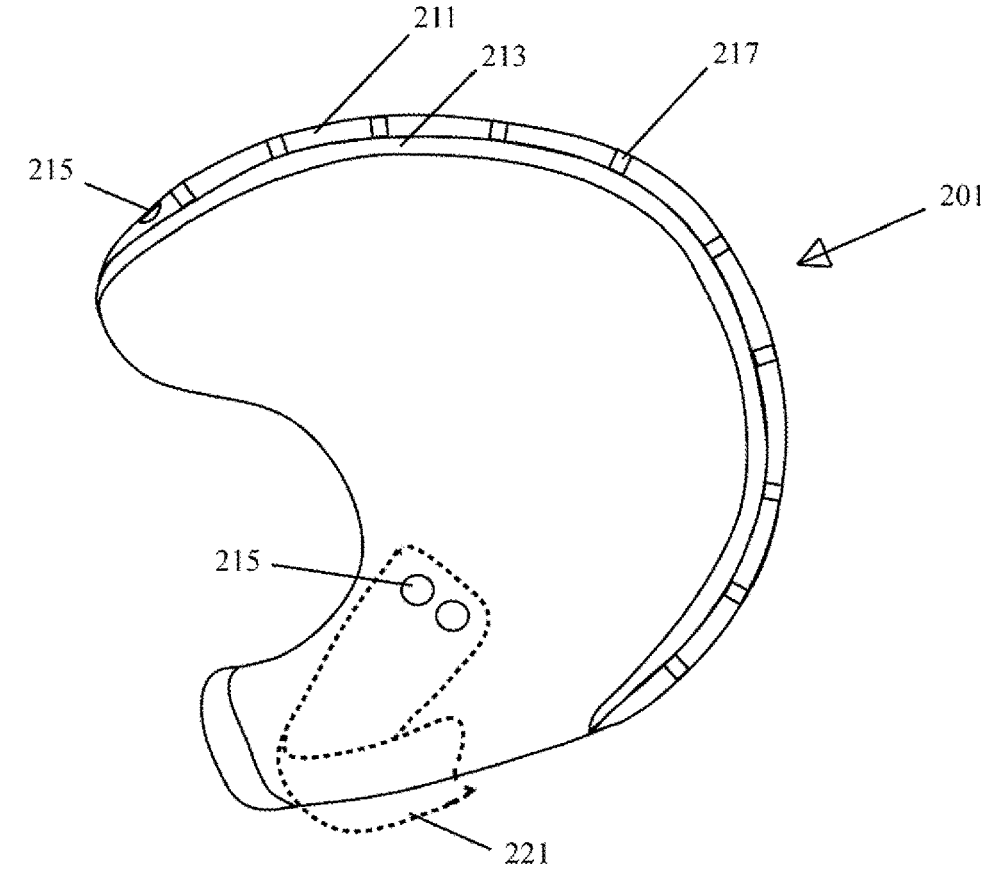
FIG. 2 illustrates one example of a piece of protective gear.
Figure 2:
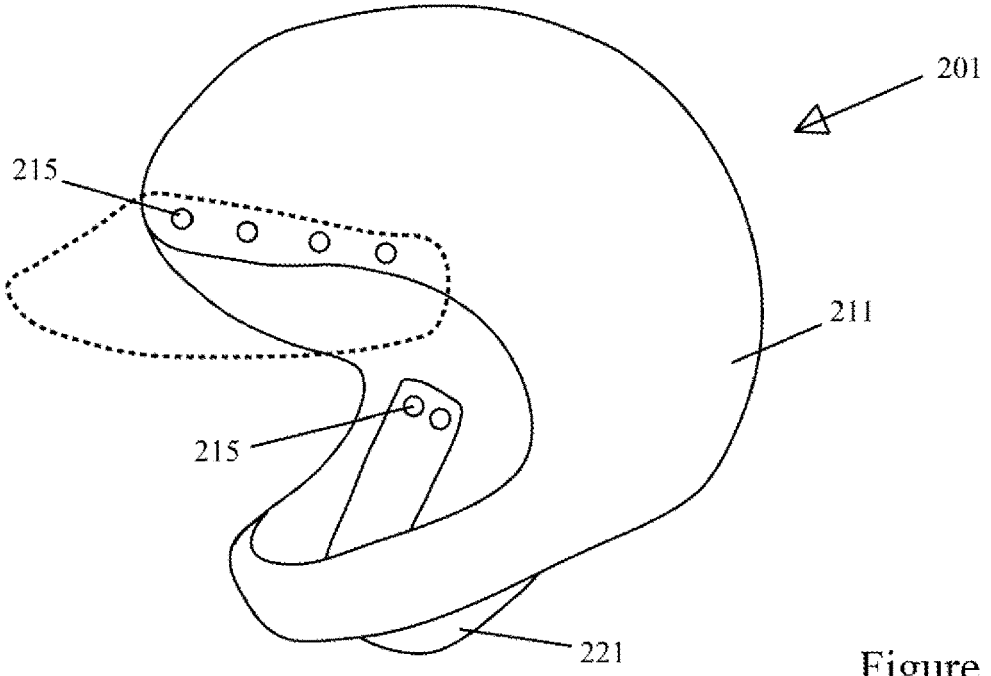

FIG. 2 illustrates one example of a particular piece of protective gear. Helmet 201 includes a shell layer 211 and a lining layer 213. The shell layer 211 includes attachment points 215 for a visor, chin bar, face guard, face cage, or face protection mechanism generally. In some examples, the shell layer 211 includes ridges 217 and/or air holes for breathability. The shell layer 211 may be constructed using plastics, resins, metal, composites, etc. In some instances, the shell layer 211 may be reinforced using fibers such as aramids. The shell layer 211 helps to distribute mechanical energy and prevent penetration. The shell layer 211 is typically made using lighter weight materials to prevent the helmet itself from causing injury.

According to various embodiments, a chin strap 221 is connected to the helmet to secure helmet positioning. The shell layer 211 is also sometimes referred to as a container or a casing. In many examples, the shell layer 211 covers a lining layer 213. The lining layer 213 may include lining materials, foam, and/or padding to absorb mechanical energy and enhance fit. A lining layer 213 may be connected to the shell layer 211 using a variety of attachment mechanisms such as glue or Velcro. According to various embodiments, the lining layer 213 is pre-molded to allow for enhanced fit and protection. According to various embodiments, the lining layer may vary, e.g. from 4 mm to 40 mm in thickness, depending on the type of activity a helmet is designed for. In some examples, custom foam may be injected into a fitted helmet to allow for personalized fit. In other examples, differently sized shell layers and lining layers may be provided for various activities and head sizes.

The shell layer 211 and lining layer 213 protect the skull nicely and have resulted in a dramatic reduction in skull fractures and bleeding between the skull and the brain (subdural and epidural hematomas). Military helmets use Kevlar to decrease penetrating injuries from bullets, shrapnel etc. Unfortunately, these approaches are not well designed to decrease direct forces and resultant coup-contra coup injuries that result in both contusions and compression-tension axon injuries. Furthermore, many helmets do not protect against rotational forces that are a core cause of a shear injury and resultant long-term neurological disability in civilian and military personnel. Although the introduction of Kevlar in military helmets has decreased mortality from penetrating head injuries, the survivors are often left with debilitating neurological deficits due to contusions and diffuse axonal injury.

Figure 3:
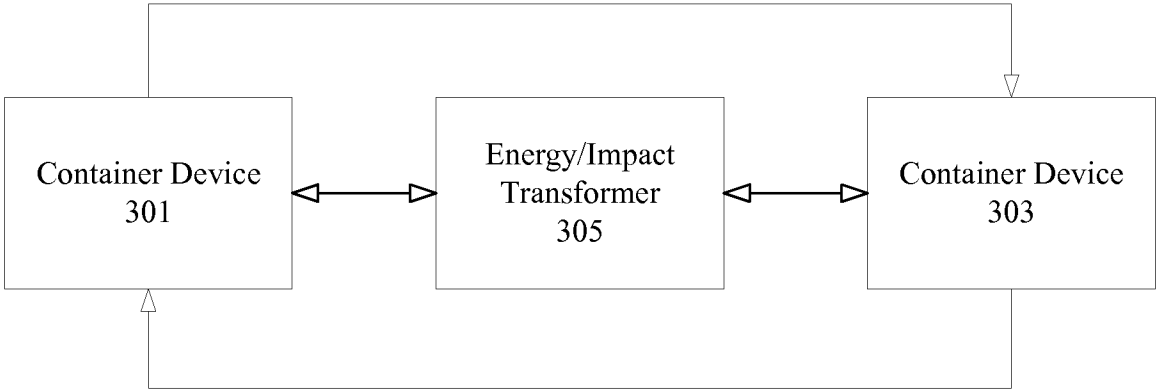
FIG. 3 illustrates one example of a container device system.

FIG. 3 illustrates one example of a container device system. According to various embodiments, protective gear includes multiple container devices 301 and 303. In particular embodiments, the multiple container devices are loosely interconnected shells holding an energy and impact transformer 305. The multiple container devices may be multiple plastic and/or resin shells. In some examples, the containers devices 301 and 303 may be connected only through the energy and impact transformer 305. In other examples, the container devices 301 and 303 may be loosely connected in a manner supplementing the connection by the energy and impact transformer 305.

According to various embodiments, the energy and impact transformer 305 may use a shear truss-like structure connecting the container 301 and container 303 to dampen any force or impact. In some examples, the energy and impact transformer 305 allows the container 301 to move or slide with respect to container 303. In some examples, up to several centimeters of relative movement is allowed by the energy and impact transformer 305.

In particular embodiments, the energy and impact transformer 305 could be a material that absorbs/dissipates mechanical energy as thermal energy or transformational energy and may include electro-rheological, magneto-rheological, foam, fluid, and/or gel materials.

Figure 4:
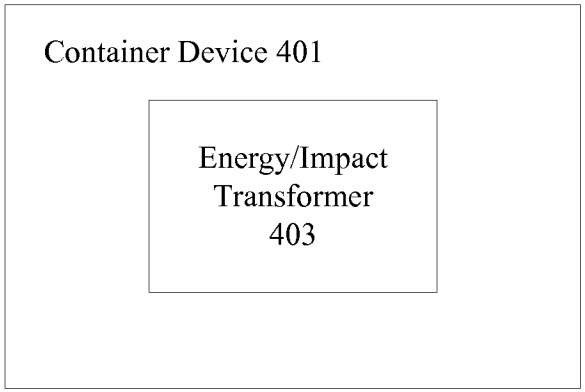
FIG. 4 illustrates another example of a container device system.

FIG. 4 illustrates another example of a container device system. Container 401 encloses energy and impact transformer 403. In some examples, multiple containers or multiple shells may not be necessary. The container may be constructed using plastic and/or resin. And may expand or contract with the application of force. The energy and impact transformer 403 may similarly expand or contract with the application of force. The energy and impact transformer 403 may receive and convert energy from physical impacts on a container 401.

Figure 5:
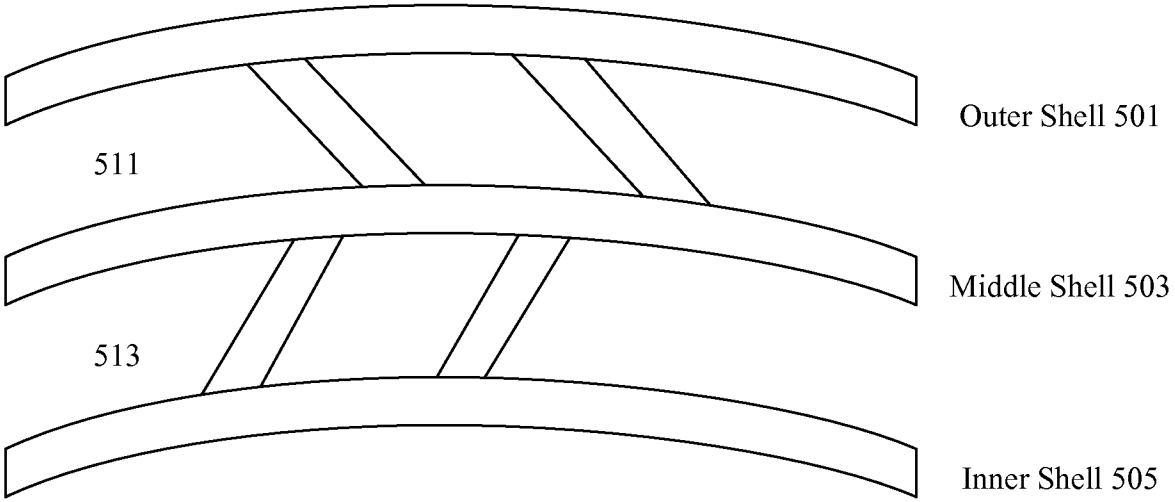
FIG. 5 illustrates one example of a multiple shell system.

FIG. 5 illustrates one example of a multiple shell system. An outer shell 501, a middle shell 503, and an inner shell 505 may hold energy and impact transformative layers 511 and 513 between them. Energy and impact transformer layer 511 residing between shells 501 and 503 may allow shell 501 to move and/or slide with respect to middle shell 503. By allowing sliding movements that convert potential head rotational forces into heat or transformation energy, shear forces can be significantly reduced.

Similarly, middle shell 503 can move and slide with respect to inner shell 505. In some examples, the amount of movement and/or sliding depends on the viscosity of fluid in the energy and impact transformer layers 511 and 513. The viscosity may change depending on electric field or voltage applied. In some other examples, the amount of movement and/or sliding depends on the materials and structures of materials in the energy and impact transformer layers 511 and 513.

According to various embodiments, when a force is applied to an outer shell 501, energy is transferred to an inner shell 505 through a suspended middle shell 503. The middle shell 503 shears relative to the top shell 501 and inner shell 505. In particular embodiments, the energy and impact transformer layers 511 and 513 may include thin elastomeric trusses between the shells in a comb structure. The energy and impact transformer layers 511 and 513 may also include energy dampening/absorbing fluids or devices.

According to various embodiments, a number of different physical structures can be used to form energy and impact transformer layers 511 and 513. In some examples, energy and impact transformer layer 511 includes a layer of upward or downward facing three dimensional conical structures separating outer shell 501 and middle shell 503. Energy and impact transformer layer 513 includes a layer of upward or downward facing conical structures separating middle shell 503 and inner shell 505. The conical structures in energy and impact transformer layer 511 and the conical structures in energy and impact transformer layer 513 may or may not be aligned. In some examples, the conical structures in layer 511 are misaligned with the conical structures in layer 513 to allow for improved shear force reduction.

In some examples, conical structures are designed to have a particular elastic range where the conical structures will return to the same structure after force applied is removed. The conical structures may also be designed to have a particular plastic range where the conical structure will permanently deform if sufficient rotational or shear force is applied. The deformation itself may dissipate energy but would necessitate replacement or repair of the protective gear.

Conical structures are effective in reducing shear, rotational, and impact forces applied to an outer shell 501. Conical structures reduce shear and rotational forces applied from a variety of different directions. According to various embodiments, conical structures in energy and impact transformer layers 511 are directed outwards with bases situated on middle shell 503 and inner shell 505 respectively. In some examples, structures in the energy and impact transformer layer may be variations of conical structures, including three dimensional pyramid structures and three dimensional parabolic structures. In still other examples, the structures may be cylinders.

Figure 6:
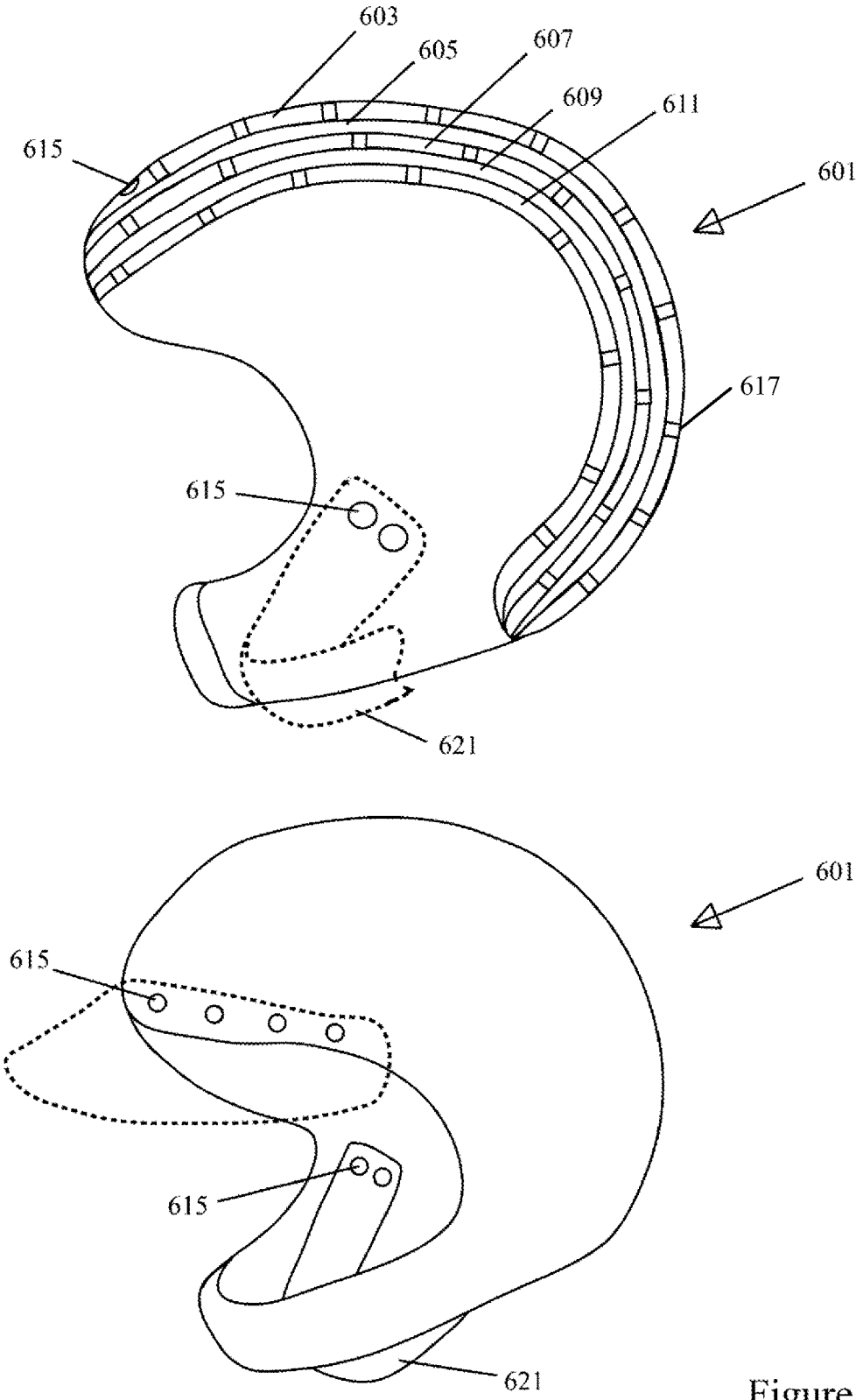
FIG. 6 illustrates one example of a multiple shell helmet.

FIG. 6 illustrates one example of a multiple shell helmet. According to various embodiments, helmet 601 includes an outer shell layer 603, an outer energy and impact transformer 605, a middle shell layer 607, an inner energy and impact transformer 609, and an inner shell layer 611. The helmet 601 may also include a lining layer within the inner shell layer 611. In particular embodiments, the inner shell layer 611 includes attachment points 615 for a chin strap for securing helmet 601. In particular embodiments, the outer shell layer 603 includes attachment points for a visor, chin bar, face guard, face cage, and/or face protection mechanism 615 generally. In some examples, the inner shell layer 611, middle shell layer 607, and outer shell layer 603 include ridges 617 and/or air holes for breathability. The outer shell layer 603, middle shell layer 607, and inner shell layer 611 may be constructed using plastics, resins, metal, composites, etc. In some instances, the outer shell layer 603, middle shell layer 607, and inner shell layer 611 may be reinforced using fibers such as aramids. The energy and impact transformer layers 605 and 609 can help distribute mechanical energy and shear forces so that less energy is imparted on the head.

According to various embodiments, a chin strap 621 is connected to the inner shell layer 611 to secure helmet positioning. The various shell layers are also sometimes referred to as containers or casings. In many examples, the inner shell layer 611 covers a lining layer (not shown). The lining layer may include lining materials, foam, and/or padding to absorb mechanical energy and enhance fit. A lining layer may be connected to the inner shell layer 611 using a variety of attachment mechanisms such as glue or Velcro. According to various embodiments, the lining layer is pre-molded to allow for enhanced fit and protection. According to various embodiments, the lining layer may vary, e.g. from 4 mm to 40 mm in thickness, depending on the type of activity a helmet is designed for. In some examples, custom foam may be injected into a fitted helmet to allow for personalized fit. In other examples, differently sized shell layers and lining layers may be provided for various activities and head sizes.

The middle shell layer 607 may only be indirectly connected to the inner shell layer 611 through energy and impact transformer 609. In particular embodiments, the middle shell layer 607 floats above inner shell layer 611. In other examples, the middle shell layer 607 may be loosely connected to the inner shell layer 611. In the same manner, outer shell layer 603 floats above middle shell layer 607 and may only be connected to the middle shell layer through energy and impact transformer 605. In other examples, the outer shell layer 603 may be loosely and flexibly connected to middle shell layer 607 and inner shell layer 611. The shell layers 603, 607, and 611 provide protection against penetrating forces while energy and impact transformer layers 605 and 609 provide protection against compression forces, shear forces, rotational forces, etc. According to various embodiments, energy and impact transformer layer 605 allows the outer shell 603 to move relative to the middle shell 607 and the energy and impact transformer layer 609 allows the outer shell 603 and the middle shell 607 to move relative to the inner shell 611. Compression, shear, rotation, impact, and/or other forces are absorbed, deflected, dissipated, etc., by the various layers.

According to various embodiments, the skull and brain are not only provided with protection against skull fractures, penetrating injuries, subdural and epidural hematomas, but also provided with some measure of protection against direct forces and resultant coup-contra coup injuries that result in both contusions and compression-tension axon injuries. The skull is also protected against rotational forces that are a core cause of a shear injury and resultant long-term neurological disability in civilian and military personnel.

In some examples, the energy and impact transformer layers 605 and 609 may include passive, semi-active, and active dampers. According to various embodiments, the outer shell 603, middle shell 607, and the inner shell 611 may vary in weight and strength. In some examples, the outer shell 603 has significantly more weight, strength, and structural integrity than the middle shell 607 and the inner shell 611. The outer shell 603 may be used to prevent penetrating forces, and consequently may be constructed using higher strength materials that may be more expensive or heavier.

FIGS. 7A-D illustrate examples of concertinaed structures that can be used in helmets or other protective gear. Specifically, the concertinaed structures are used to connect shell layers of a helmet or protective gear. According to various embodiments, these concertinaed structures can be expandable and collapsible, and can allow shell layers to move relative to each other when mechanical forces are imparted onto the outer shell layer. In some examples, the concertinaed structures can form accordion-like structures that can expand or contract under various forces. The mechanical forces can include impact forces, rotational forces, shear forces, and other forces.

In some embodiments, the concertinaed structures can be made of flexible materials having a range of properties. Depending on the application, the flexible materials can operate in elastic and/or plastic ranges. For instance, for minor impacts to the outer shell layer, the flexible materials may operate in the elastic range, such that the concertinaed structures return to their original positions after the helmet or protective gear returns to rest. In other examples, the flexible materials can be chosen to strain into the plastic range when an impact exceeds a certain force. In such cases, the concertinaed structures can absorb some of the energy imparted from the impact. Because the concertinaed structures would undergo plastic deformation in these cases, the concertinaed structures would need to be replaced before the helmet or protective gear could be used as effectively in the future.

Figure 7A:
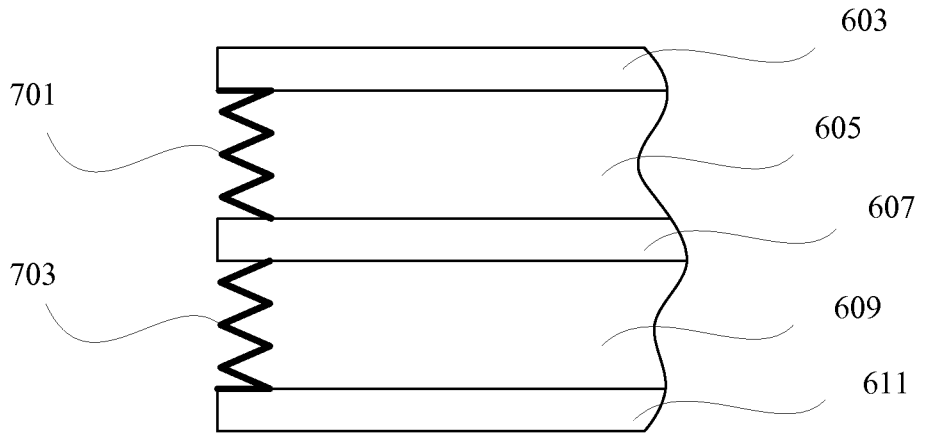
FIGS. 7A-D illustrate examples of concertinaed structures used in a helmet or other protective gear.

With reference to FIG. 7A, shown is one example of concertinaed structures used in helmets or protective gear. In particular, concertinaed structure 701 connects outer shell layer 603 and middle shell layer 607 such that outer shell layer 603 and middle shell layer 607 can move relative to each other when a mechanical force is applied to outer shell layer 603. According to various examples, the concertinaed structure 701 can expand or contract to allow the shell layers to move in various ways, such as sliding, rotating, torqueing, etc. In addition, the concertinaed structure 701 can allow the outer shell layer 603 and middle shell layer 607 to move closer to or further from each other.

In the present embodiment, concertinaed structure 703 connects middle shell layer 607 and inner shell layer 611 such that middle shell layer 607 and inner shell layer 611 can move relative to each other when a mechanical force is applied to outer shell layer 603. According to various examples, the concertinaed structure 703 can expand or contract to allow the shell layers to move in various ways, such as sliding, rotating, torqueing, etc. In addition, the concertinaed structure 703 can allow the middle shell layer 607 and inner shell layer 611 to move closer to or further from each other. Furthermore, according to various embodiments, concertinaed structures 701 and 703 can allow expansion, contraction, or other movement from outer energy and impact transformer 605 and inner energy and impact transformer 609.

Figure 7B:
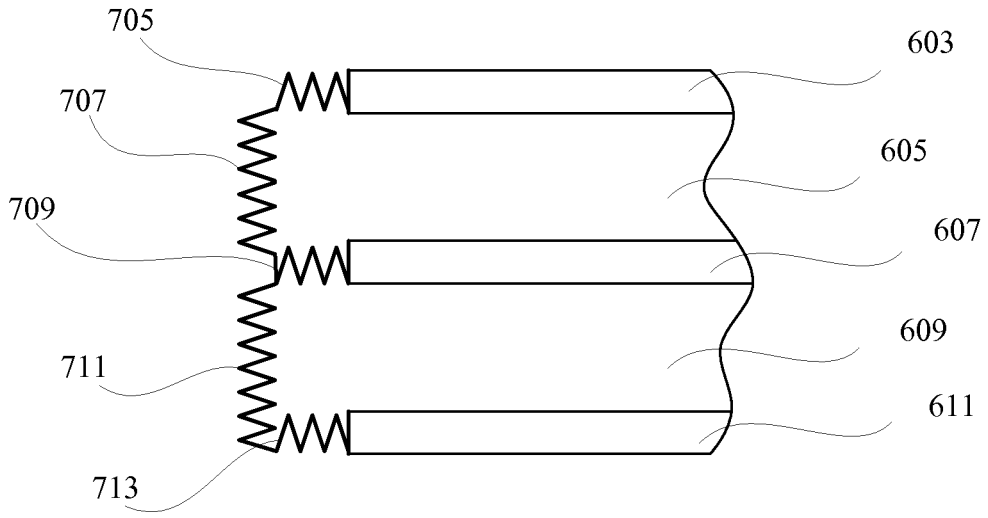

With reference to FIG. 7B, shown is another example of concertinaed structures used in helmets or protective gear. In the present example, concertinaed structure 705 is an extension of outer shell layer 603, concertinaed structure 709 is an extension of middle shell layer 607, and concertinaed structure 713 is an extension of inner shell layer 611. Specifically, concertinaed structures 705, 709, and 713 are located at the distal ends of shell layers 603, 607, and 611, respectively. Furthermore, concertinaed structure 707 connects outer shell layer 603 and middle shell layer 607 through concertinaed structures 705 and 709, respectively. In addition, concertinaed structure 711 connects middle shell layer 607 and inner shell layer 611 through concertinaed structures 709 and 713, respectively. Concertinaed structures 705, 707, 709, 711, and 713 can expand or contract to allow the shell layers to move in various ways, such as sliding, rotating, torqueing, etc. In addition, concertinaed structures 705, 707, 709, 711, and 713 can allow the shell layers to move closer to or further from each other. Furthermore, according to various embodiments, concertinaed structures 705, 707, 709, 711, and 713 can allow expansion, contraction, or other movement from outer energy and impact transformer 605 and inner energy and impact transformer 609. In the present example, outer shell layer 603 and inner shell layer 611 can be considered to be connected to each other through concertinaed structures 707, 709, and 713.

Figure 7C:
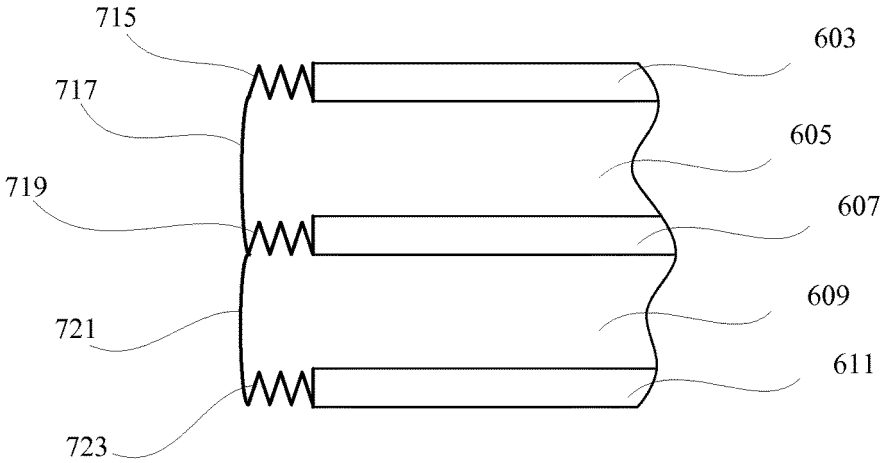

With reference to FIG. 7C, shown is another example of concertinaed structures used in helmets or protective gear. In the present example, concertinaed structure 715 is an extension of outer shell layer 603, concertinaed structure 719 is an extension of middle shell layer 607, and concertinaed structure 723 is an extension of inner shell layer 611. Specifically, concertinaed structures 715, 719, and 723 are located at the distal ends of shell layers 603, 607, and 611, respectively. Connective structure 717 connects outer shell layer 603 and middle shell layer 607 through concertinaed structures 715 and 719, respectively. In addition, connective structure 721 connects middle shell layer 607 and inner shell layer 611 through concertinaed structures 719 and 723, respectively. Concertinaed structures 715, 719, and 723 can expand or contract to allow the shell layers to move in various ways, such as sliding, rotating, torqueing, etc. In addition, concertinaed structures 715, 719, and 723 can allow the shell layers to move closer to or further from each other. Furthermore, according to various embodiments, concertinaed structures 715, 719, and 723 can allow expansion, contraction, or other movement from outer energy and impact transformer 605 and inner energy and impact transformer 609.

According to various embodiments, connective structures 717 and 721 can be made of a range of materials, depending on the application. For instance, connective structures 717 and 721 can be made of flexible materials that allow movement when the shell layers move relative to each other. In other examples, connective structures 717 and 721 can be more rigid structures that allow the concertinaed structures 715, 719, and 723 to expand and contract, and consequently allow the shell layers to move relative to each other.

Figure 7D:
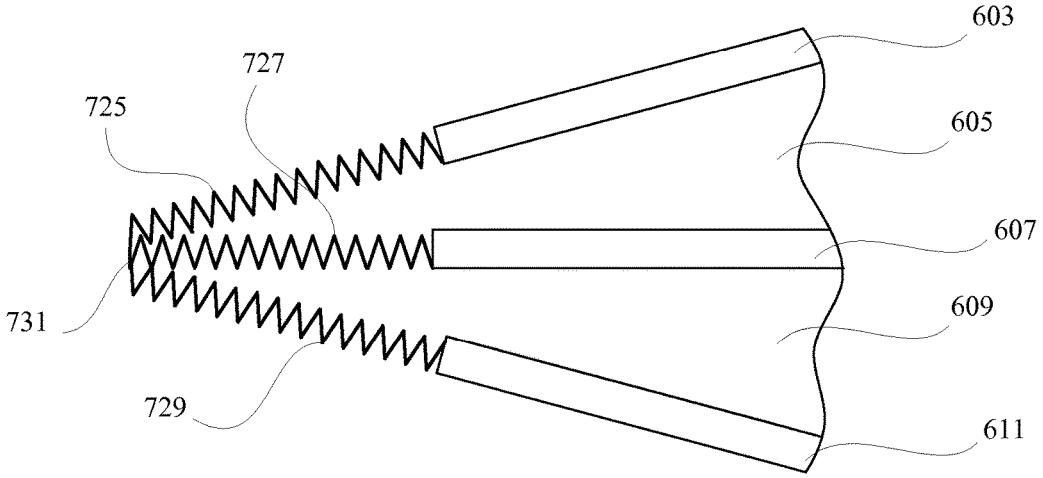

With reference to FIG. 7D, shown is yet another example of concertinaed structures used in helmets or protective gear. In the present example, concertinaed structure 725 is an extension of outer shell layer 603, concertinaed structure 727 is an extension of middle shell layer 607, and concertinaed structure 729 is an extension of inner shell layer 611. Specifically, concertinaed structures 725, 727, and 729 are located at the distal ends of shell layers 603, 607, and 611, respectively.

In the present example, concertinaed structures 725, 727, and 729 meet at connection 731 to join all three shell layers 603, 607, and 611. Concertinaed structures 725, 727, and 729 can expand or contract to allow the shell layers to move in various ways, such as sliding, rotating, torqueing, etc. In addition, concertinaed structures 725, 727, and 729 can allow the shell layers to move closer to or further from each other. Furthermore, according to various embodiments, concertinaed structures 725, 727, and 729 can allow expansion, contraction, or other movement from outer energy and impact transformer 605 and inner energy and impact transformer 609.

Although the foregoing invention has been described in some detail for purposes of clarity of understanding, it will be apparent that certain changes and modifications may be practiced within the scope of the appended claims. Therefore, the present embodiments are to be considered as illustrative and not restrictive and the invention is not to be limited to the details given herein, but may be modified within the scope and equivalents of the appended claims.

The invention claimed is:

1. A helmet comprising:
an outer shell layer;
a middle shell layer;
an inner shell layer;
a plurality of concertinaed structures, each concertinaed structure comprising a plurality of structural members coupled at adjacent ends such that each pair of coupled structural members forms a V-shaped fold, the plurality of concertinaed structures including:
an outer concertinaed structure, wherein the outer concertinaed structure is an extension of the outer shell layer and is disposed on a distal end of the outer shell layer; and
a middle concertinaed structure, wherein the middle concertinaed structure is an extension of the middle shell layer and is disposed on a distal end of the middle shell layer;
an inner concertinaed structure, wherein the inner concertinaed structure is an extension of the inner shell layer and is disposed on a distal end of the inner shell layer;
a fourth concertinaed structure,
wherein a first end of the fourth concertinaed structure is attached to a distal end of the outer concertinaed structure, and
wherein a second end of the fourth concertinaed structure is attached to a distal end of the middle concertinaed structure to allow the outer shell layer to move relative to the middle shell layer when mechanical forces are imparted onto the helmet; and
a fifth concertinaed structure,
wherein a first end of the fifth concertinaed structure is attached to the distal end of the middle concertinaed structure, and
wherein a second end of the fifth concertinaed structure is attached to a distal end of the inner concertinaed structure to allow the inner shell layer to move relative to the middle shell layer when mechanical forces are imparted onto the helmet.

2. The helmet of claim 1, wherein the outer concertinaed structure is expandable and collapsible.

3. The helmet of claim 1, wherein the mechanical forces include impact forces.

4. The helmet of claim 1, wherein the mechanical forces include rotational and shear forces.

5. A protective garment, comprising:
an outer shell layer;
a middle shell layer;
an inner shell layer;
a plurality of concertinaed structures, each concertinaed structure comprising a plurality of structural members coupled at adjacent ends such that each pair of coupled structural members forms a V-shaped fold, the plurality of concertinaed structures including:
an outer concertinaed structure, wherein the outer concertinaed structure is an extension of the outer shell layer and is disposed on a distal end of the outer shell layer; and
a middle concertinaed structure, wherein the middle concertinaed structure is an extension of the middle shell layer and is disposed on a distal end of the middle shell layer;
an inner concertinaed structure, wherein the inner concertinaed structure is an extension of the inner shell layer and is disposed on a distal end of the inner shell layer;
a fourth concertinaed structure,
wherein a first end of the fourth concertinaed structure is attached to a distal end of the outer concertinaed structure, and
wherein a second end of the fourth concertinaed structure is attached to a distal end of the middle concertinaed structure to allow the outer shell layer to move relative to the middle shell layer when mechanical forces are imparted onto the protective garment; and
a fifth concertinaed structure,
wherein a first end of the fifth concertinaed structure is attached to the distal end of the middle concertinaed structure, and
wherein a second end of the fifth concertinaed structure is attached to a distal end of the inner concertinaed structure to allow the inner shell layer to move relative to the middle shell layer when mechanical forces are imparted onto the protective garment.

6. The protective garment of claim 5, wherein the outer concertinaed structure is expandable and collapsible.

7. The protective garment of claim 5, wherein the mechanical forces include impact forces.

8. The protective garment of claim 5, wherein the mechanical forces include rotational and shear forces.

* * * * *